US006601733B1

(12) United States Patent
Schnacky et al.

(10) Patent No.: US 6,601,733 B1
(45) Date of Patent: Aug. 5, 2003

(54) MULTI-COMPONENT PROPORTIONING SYSTEM AND DELIVERY SYSTEM UTILIZING SAME

(75) Inventors: Jayme L. Schnacky; Alan A. Burmester, both of Rice Lake; Vincent F. Genatempo, Jr., Cameron, all of WI (US); John C. Larson, West Chester, PA (US)

(73) Assignees: E. I. du Pont de Nemours and Company, Wilmington, DE (US); Rice Lake Weighing Systems, Inc., Rice Lake, WI (US)

( * ) Notice: Subject to any disclaimer, the term of this patent is extended or adjusted under 35 U.S.C. 154(b) by 0 days.

(21) Appl. No.: 09/405,887

(22) Filed: May 29, 2001

(51) Int. Cl.[7] ..... B67D 5/52
(52) U.S. Cl. ..... 222/135; 222/134; 222/267
(58) Field of Search ..... 222/135, 134, 222/267

(56) References Cited

U.S. PATENT DOCUMENTS

| | | | | |
|---|---|---|---|---|
| 2,980,292 A | * | 4/1961 | Taylor | 222/36 |
| 3,306,495 A | * | 2/1967 | Wabers | 222/77 |
| 3,638,837 A | * | 2/1972 | Fullerton | 222/134 |
| 3,790,030 A | * | 2/1974 | Ives | 222/135 |
| 4,286,732 A | * | 9/1981 | James et al. | 222/46 |
| 4,432,470 A | * | 2/1984 | Sopha | 222/135 |
| 4,493,286 A | * | 1/1985 | Carson | 118/677 |
| 4,844,706 A | | 7/1989 | Katsuyama et al. | |
| 4,941,596 A | * | 7/1990 | Marty et al. | 222/144.5 |
| 5,260,101 A | | 11/1993 | Larson et al. | |
| 5,425,968 A | | 6/1995 | Larson | |
| 5,636,972 A | * | 6/1997 | Richter et al. | 417/199.1 |

FOREIGN PATENT DOCUMENTS

WO 98/41316 A1 9/1998

* cited by examiner

*Primary Examiner*—William C. Doerrler
*Assistant Examiner*—Frederick C Nicolas
(74) *Attorney, Agent, or Firm*—Sudhir G. Deshmukh

(57) ABSTRACT

A multi-component proportioning system for dispensing a multi-component coating composition is provided. The delivery system is particularly useful in providing multi-component compositions to a multi-component dispenser. The system provides very accurate mix ratios due to the consistent, reproducible displacement of components from the liquid pump assemblies used in the multi-component proportioning system regardless of viscosity. Such accuracy eliminates improper mixing of components that can lead to reworking and lost time, materials, and profits.

3 Claims, 5 Drawing Sheets

MULTI-COMPONENT PROPORTIONING SYSTEM AND DELIVERY SYSTEM UTILIZING SAME

FIELD OF INVENTION

The present invention relates to a multi-component proportioning system and a delivery system utilizing the proportioning system as well as a method of using the system. The delivery system is particularly useful in providing multi-component compositions to a multi-component dispenser which then can then deliver the components, for example, to a siphon or gravity-fed spray gun.

BACKGROUND OF THE INVENTION

Various means have been suggested for proportioning and applying two or more components to a surface. In one such device, a main component and a secondary component are mixed together at an intermediate portion of a supply conduit to a coating spray gun. Check valves are provided upstream of a junction to prevent backflow from the junction and stop valves are provided in flow portions between the check valves and the junction to stop flow of material when the spray gun is shut off.

In another coating material supply device, coating materials reportedly are pumped by hydraulically controlled reciprocal pumps from a supply source at a constant flow rate by the pressure of a hydraulic fluid. In each of the hydraulically-powered reciprocal pumps, a coating material chamber having an inlet and exit and a hydraulic fluid chamber receiving the supply of the hydraulic fluid are formed adjacent with each other by way of a diaphragm so that the coating material in the coating material chamber is pumped out at a constant flow rate by the diaphragm.

A safety shut-down device for two-component sprayer systems is disclosed wherein the device is disposed in the compressed air line of a spray system particularly that which powers the spray component air motors and pumps. A pneumatically controlled main valve cuts off the compressed air to the air motors upon detection of a deficiency condition, i.e., lack of component pressure. Pressure is measured by pressure transducers which mechanically actuate deficiency valves.

In another multi-component spraying system, materials are pump-driven to a spraying means which includes a nozzle assembly which has a liquid nozzle for forming liquid, e.g., resin, into a fan-like film from a liquid orifice and a nozzle assembly for directing a flow of compressed air and catalyst at the film closely adjacent the orifice. Alternatively, compressed air impinges on a fan-like stream of resin and catalyst together prior to exiting the nozzle assembly as a mixture. The air pumps for each component being fed into the nozzle assembly may be individually controlled and the mixing unit for the materials may be carried, for example, on the belt of an operator, to reduce the weight of the hand-held spray gun.

In a device for simultaneously discharging a plurality of fluids. with or without mixing, the underside of a pistol grip handle of a spray gun or fuel nozzle is formed with a socket for a rotary insert which is connected to two or more supply conduits for flowable materials. The fluids to be discharged are presumed to be provided to the supply conduits by known means.

A multi-component system for applying a coating onto a substrate is provided whereby a plurality of separate components is supplied with at least one component being under pressure. Each component is transported to a common proportioning device powered by the pressure to provide a controlled volumetric ratio of the components. The components are homogeneously mixed to form a composition and the composition is sprayed or coated onto the surface of a substrate. The coating composition doubles in viscosity in centipoise at a temperature of 25° C. within a time period of less than 45 minutes from the time of composition formation.

A two-component pressure feed system is disclosed wherein a first tank is provided within which a second tank is located and separated from the first tank by a membrane. One component is held in each tank. Pressurized air is fed to the containers and, via a regulator, a regulator pipe and through an aperture in the lid. Pressurized air feeds the fluid components via tubes to a spray gun, where the components combine to be sprayed.

An apparatus for applying multi-component coating compositions is also disclosed wherein at least two dosing devices, and air-assisted spray gun and a controlling device. Each dosing device has a supply container containing a component, a motor with a power controller, and a metering device. In each dosing device, the supply container is connected to the metering device which is connected the motor and to the spray gun. A connecting line between at least one metering device and the spray gun is fitted with a pressure transducer having means for measuring a decrease in pressure in the line and being connected to a control device connected to the motors to keep the pressure in the connecting line to a set value.

SUMMARY OF THE INVENTION

The present invention, in one aspect, provides a multi-component proportioning system for a multi-component coating composition comprising:

1) first, second, third and fourth pressurized air ports in a first valve assembly;
2) the second and third pressurized air ports being connected to a first air cylinder proximate the first and second terminal portions thereof,
3) the first and fourth ports being connected to an air cylinder associated with a second valve at the first and second terminal ends thereof,
4) first and second exhaust ports on the second valve and being connected to a second cylinder proximate the first and second terminal portions thereof and to quick exhaust valves;
5) a liquid pump assembly for each component, said liquid pump assembly comprising a piston which moves between a first and second chamber for the component and a piston rod attached to the piston extending beyond the pump assembly body;
6) a first and second trip plate adapted for contact with the piston rod associated with the liquid pump assembly for the first and second component;
7) an air pilot operator connected to the trip plate, the air pilot operator being adapted to contact a trip button in the first valve, the trip button determining air flow to the first, second, third and fourth air ports in the first valve; and
8) a spool valve assembly associated with each liquid pump assembly and having a component inlet port and a component outlet port, the inlet and outlet ports being connected to the chambers of the liquid pump assembly by passageways and a spool valve capable of directing incoming component entering from the inlet port to one chamber of the liquid pump assembly through a passageway and allowing outgoing component to exit from the other chamber of the liquid pump assembly through a passageway to the component outlet port, each spool valve assembly being further connected to the first air cylinder by connecting rods, the spool valve assemblies for the first and second components being connected to the first and second terminal portions of the first air cylinder, respectively;

such that when:

1) the first and second lines are pressurized with air, air flows from the first line to the second valve and through the first exhaust port and from the second line to the second terminal portion of the first cylinder, the first chambers of the liquid pump assemblies can fill with components through the spool valves attached thereto and components in the second chambers of the liquid pump assemblies can exit past the spool valve, while the piston with its rod moves across the liquid pump assembly and air exhausts through the third and fourth lines;

2) when the third and fourth lines are pressurized with air, air flows from the fourth line to the second valve and through the second exhaust port and from the third line to the first terminal portion of the first cylinder, the second chambers of the liquid pump assemblies fill with components through the spool valves attached thereto and components in the first chambers of the liquid pump assemblies exit past the spool valve and air exhausts through the first and second air ports;

3) when the first trip plate contacts the trip button in the first valve, the air pilot operator in the second valve, the piston and the spool valve simultaneously change direction, the piston and spool valve traveling in opposite directions, the pistons being operated by air pressure and the spool valves being mechanically operated.

Where more than two liquid pump assemblies and spool valve assemblies are required for the compositions containing more than two components, additional liquid pump assemblies and spool valve assemblies may be added by connecting the piston rod of the additional liquid pump assembly to the piston of the liquid pump assembly adjacent thereto and the spool valve attached to the air cylinder to the spool valve of the additional spool valve assembly by a rod or other means known to those skilled in the art with appropriate alignment being maintained.

The relative ratios of each component being fed out of the proportioning system is determined by the total volume of component capable of being held in each of the chambers of the liquid pump assemblies and is proportional thereto. Virtually any ratio of components can be achieved by using liquid pump assemblies of the appropriate volumetric capacities.

The multi-component proportioning system of the present invention provides many advantages over previously known systems. The system provides very accurate mix ratios due to the consistent, reproducible displacement of components from the liquid pump assemblies regardless of viscosity. Such accuracy eliminates improper mixing of components that can lead to reworking and lost time, materials, and profits.

The present invention, in another aspect, provides a multi-component delivery system utilizing the proportioning system of the invention The multi-component delivery system comprises:

1) a supply source for each component;

2) a multi-component proportioning system for a multi-component coating composition comprising:

a) first, second, third and fourth pressurized air ports in a first valve assembly;

b) the second and third pressurized air ports being connected to a first air cylinder proximate the first and second terminal portions thereof, c) the first and fourth ports being connected to an air cylinder associated with a second valve at the first and second terminal ends thereof;

d) first and second exhaust ports on the second valve and being connected to a second cylinder proximate the first and second terminal portions thereof and to quick exhaust valves;

e) a liquid pump assembly for each component, said liquid pump assembly comprising a piston which moves between a first and second chamber for the component and a piston rod attached to the piston extending beyond the pump assembly body;

f) a first and second trip plate adapted for contact with the piston rod associated with the liquid pump assembly for the first and second component;

g) an air pilot operator connected to the trip plate, the air pilot operator being adapted to contact a trip button in the first valve, the trip button determining air flow to the first, second, third and fourth air ports in the first valve; and h) a spool valve assembly associated with each liquid pump assembly and having a component inlet port and a component outlet port, the inlet and outlet ports being connected to the chambers of the liquid pump assembly by passageways and a spool valve capable of directing incoming component entering from the inlet port to one chamber of the liquid pump assembly through a passageway and allowing outgoing component to exit from the other chamber of the liquid pump assembly through a passageway to the component outlet port, each spool valve assembly being further connected to the first air cylinder by connecting rods, the spool valve assemblies for the first and second components being connected to the first and second terminal portions of the first air cylinder, respectively, such that when:

a) the first and second lines are pressurized with air, air flows from the first line to the second valve and through the first exhaust port and from the second line to the second terminal portion of the first cylinder, the first chambers of the liquid pump assemblies can fill with components through the spool valves attached thereto and components in the second chambers of the liquid pump assemblies can exit past the spool valve, while the piston with its rod moves across the liquid pump assembly and air exhausts through the third and fourth lines;

b) when the third and fourth lines are pressurized with air, air flows from the fourth line to the second valve and through the second exhaust port and from the third line to the first terminal portion of the first cylinder, the second chambers of the liquid pump assemblies fill with components through the spool valves attached thereto and components in the first chambers of the liquid pump assemblies exit past the spool valve and air exhausts through the first and second air ports;

c) when the first trip plate contacts the trip button in the first valve, the air pilot operator in the second valve, the piston and the spool valve simultaneously change direction, the piston and spool valve traveling in opposite directions, the pistons being operated by air pressure and the spool valves being mechanically operated.

3) means for connecting each supply source to the component inlet port on a spool valve assembly, 4) means for connecting each component outlet port to a dispenser adapted to individually deliver the components to a coating device.

A flushing system may also be provided by adding a flush assembly to discontinue supply of the components and supply the inlets of each spool assembly with an appropriate cleaning solution.

The combination of the spool valve assembly, liquid pump assembly, mechanical and air pressure control and the quick exhaust valve virtually eliminate pulsing at the spray gun. With this delivery system, components can be fed directly from shipping containers and reactive activators can be fed by venting the container through a desiccant filter which maintains a dry atmosphere above moisture sensitive activators. This system requires no pressurized feed tanks, pumps or circulation systems to feed the components which reduces equipment needs and costs. The system further saves labor necessary in mixing components, cleaning mixing containers and handling waste over many known systems.

The present invention, in a further aspect, provides a method of using a multi-component proportioning system for a multi-component coating composition comprising the steps of:

1) providing an air pilot valve assembly comprising first and second 4-way, 5-port valves, each valve having a pressurized air inlet, the first valve having first and second Y-connectors and an air pilot operator adapted to trip a trip button within the first valve to direct air flow to the Y-connectors and the second valve having first and second air inlet ports and first and second primary exhaust ports, 2) providing a liquid pump assembly for each of at least two components, said liquid pump assembly comprising a piston which moves between a first and second chamber for the component and a piston rod attached to the piston extending beyond the pump assembly body, each of the liquid pump assembly piston rods for the first and second components being adapted to contact a trip plate, and the trip plate being connected to a piston rod adapted to traverse a second cylinder;

3) providing a spool valve assembly associated with each liquid pump assembly and having a component inlet port and a component outlet port, the inlet and outlet ports being connected to the chambers of the liquid pump assembly by passageways and a spool valve capable of directing incoming component entering from the inlet port to one chamber of the liquid pump assembly through a passageway and allowing outgoing component to exit from the other chamber of the liquid pump assembly through a passageway to the component outlet port, each spool valve assembly being further connected to a first air cylinder by connecting rods, the spool valve assemblies for the first and second components being connected to the first and second terminal portions of the first air cylinder, respectively;

4) providing pressurized air to the air inlet of the first 4-way, 5-port valve and allowing the air to exit the first valve through the first Y-connector;

5) allowing air flowing through a first port of the first Y-connector to enter into a terminal portion of a first air pilot operator portion;

6) allowing air flowing through a second port on the first Y-connector to flow into the first air cylinder and to cause a piston rod and a piston located within the first air cylinder and aligned with the central axis thereof and the spool valves to travel in a first direction;

7) allowing air to flow from the second exhaust valve of the air pilot valve assembly to an exhaust line connected to a second air cylinder and a first quick exhaust valve causing pistons and piston rods of the liquid pump assembly, the trip plate, the piston rod in the second air cylinder and the air pilot operator to travel in a direction opposite to that of the spool valves;

8) providing a component for each liquid pump assembly and associated spool valve assembly;

9) permitting the liquid pump assembly for each component to draw the component into the first chamber of the liquid pump assembly through the component inlet port of the spool valve assembly associated therewith and causing component contained in the second chamber of the liquid pump assembly to exit through the component outlet port of the spool valve assembly associated therewith;

10) allowing the spool valve and associated piston rods to continue travel in a first direction and the piston in the liquid pump assembly, the trip plate and the air pilot operator to continue travel in the opposite direction until sufficient travel has occurred that the air pilot operator contacts the trip button in first valve of the air operator assembly system causing air to flow into the second Y-connector;

11) allowing air flowing through a first port of the second Y-connector to enter into a terminal portion of a second air pilot operator portion;

12) allowing air flowing through a second port on the second Y-connector to flow into the first air cylinder and to cause the piston rod and a piston located within the cylinder and the spool valves reverse direction and to travel in a second direction opposite to the first direction;

13) allowing air to flow simultaneously with that of the air flowing through the port on the second Y-connector from the first exhaust valve of the air pilot valve assembly to an exhaust line connected to the second air cylinder and the second quick exhaust valve causing pistons and piston rods of the liquid pump assembly, the trip plate, the piston rod in the second air cylinder and the air pilot operator to reverse direction and travel in a direction opposite to that previously traveled;

14) permitting the liquid pump assembly for each component to draw the component into the second chamber of the liquid pump assembly through the component inlet port of the spool valve assembly associated therewith and causing component contained in the first chamber of the liquid pump assembly to exit through the component outlet port of the spool valve assembly associated therewith, 15) allowing the spool valve and associated piston rods to continue travel in the second direction and the piston in the liquid pump assembly, the trip plate and the air pilot operator to continue travel in the direction opposite to that previously traveled until sufficient travel has occurred that the air pilot operator contacts the trip button in first valve of the air operator assembly system causing air to flow into the first Y-connector; and 16) repeating steps 5 through 15 until stoppage of delivery of the components is desired.

DETAILED DESCRIPTION OF THE INVENTION

Hereinafter the present invention will be described in further detail with reference to the drawings.

Figure 1:
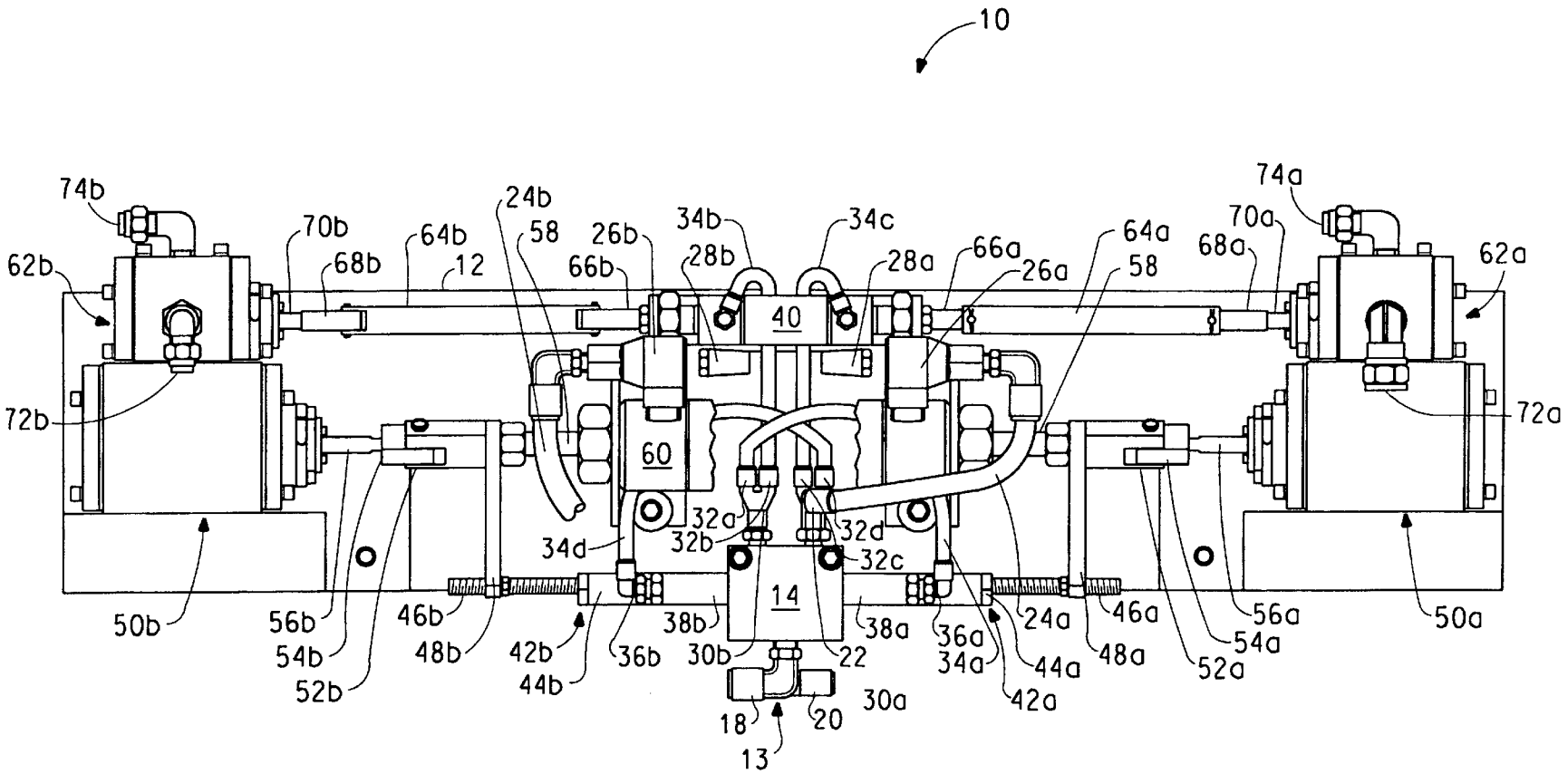
FIG. 1 is a front view of a preferred embodiment of a multi-component proportioning system of the present invention adapted for two components.

With reference to FIG. 1, the multi-component proportioning system of the invention, in this instance two-component system 10, has base plate 12. Air pilot valve system 13 includes two 4-way, 5-port valves, such as, for example, Humphrey TAC[3], Model 42PP, or the equivalent thereof, of which valve 14 is shown with the second valve, hereinafter termed "rear valve" behind and obscured by valve 14 and connected thereto; air inlet 18 is provided in valve 14 and air inlet 20 is provided in the rear valve; and exiting valve 14 are four exhaust ports, first exhaust port 22 being shown connected to line 24*a*, second exhaust port (not shown) being connected to line 24*b*. Quick exhaust valves 26*a*, 26*b*, such as, for example, Humphrey, Model SQE-2, or the equivalent thereof are attached to lines 24*a*, 24*b*. Each quick exhaust valve is shown with optional mufflers 28*a*, 28*b*. Two additional exhaust ports (not shown) are in the bottom portion of valve 14.

Further included in air pilot valve assembly 13 and extending from the rear valve are Y-connectors 30*a*, 30*b* having ports 32*a*, 32*b*, 32*c*, and 32*d*. Line 34*a* connects port 32*a* to terminal portion 36*a* of air pilot operator portion 38*a* while line 34*d* connects port 32*d* to terminal portion 36*b* of air pilot operator portion 38*b*, air pilot operator portions 38*a*, 38*b* being connected to valve 14. Lines 34*b*, 34*c* connect ports 32*b*, 32*c*, respectively, to air cylinder 40 which is attached to base plate 12. Suitable air cylinders include, for example, a BIMBA®, Model 060 5-DXDE, or the equivalent thereof Two additional exhaust ports (not shown) are in the bottom portion of the rear valve.

Air pilot operators 42*a*, 42*b* of air pilot valve assembly 13 contact a trip button (not shown) within the rear valve and air valve operator guides 44*a*, 44*b* may be used. Of course, the air pilot operator could contact the rear valve without the use of trip rod guides 44*a*, 44*b* although the system may be somewhat less sturdy. Threaded portions 46*a*, 46*b* of air valve operators 42*a*, 42*b* are connected to trip plates 48*a*, 48*b*. Trip plates 48*a*, 48*b* are further connected to piston rods 56*a*, 56*b* of liquid pump assemblies 50*a*, 50*b*, such as are well-known in the art and having various volumetric capacities, respectively by devises 54*a*, 54*b*. Piston rod 58 which traverses the longitudinal axis of cylinder 60, such as, for example, a BIMBA®, Model 312-DXDE, or the equivalent thereof, shown broken away to reveal ports 32*a–d* and lines 34*a–d*, is connected to devises 54*a*, 54*b* by clevises 52*a*, 52*b*, respectively. Liquid pump assemblies 50*a*, 50*b* and cylinder 60 are attached to base plate 12. Suitable liquid pump assemblies are and can vary in volumetric capacity from one ounce, or less, to one gallon, or more. The junctures of clevises 52*a*, 52*b* and devises 54*a*, 54*b* can be adjusted by moving air pilot operator portions 46*a*, 46*b* along trip plates 48*a*, 48*b* along threaded air pilot operator portions 46*a*, 46*b* to cause piston rods 56*a*, 56*b* of pump assemblies 50*a*, 50*b* to vary traverse length. The air pilot operator portions 46*a*, 46*b* then can contact the rear valve at the appropriate points in the pump cycles and alternately reverse the air flow between Y-connector 30*a* and Y-connector 30*b*, as will be show with respect to FIGS. 2 and 3.

Spool valve assemblies 62*a*, right hand, and 62*b*, left hand, are connected to liquid pump assemblies 50*a* and 50*b*, respectively, and to piston rods and a piston (not shown) in cylinder 40 by connecting rod clevises 64*a*, 64*b*, cylinder connectors 66*a*, 66*b* and 68*a*, 68*b*, and spool valve assembly piston rod 70*a*, 70*b*, respectively. Suitable spool valve assemblies are well-known to those skilled in the art.

Component inlet port 72*a* is provided to allow one component to enter spool valve assembly 62*a*, pass through liquid pump assembly 50*a* and exit from spool valve assembly 62*a* through component outlet port 74*a*. Component inlet port 72*b* is provided to allow the other component to enter spool valve assembly 62*b*, pass through liquid pump assembly 50*b* and exit from spool valve assembly 62*b* through component outlet port 74*b*.

Figure 2:
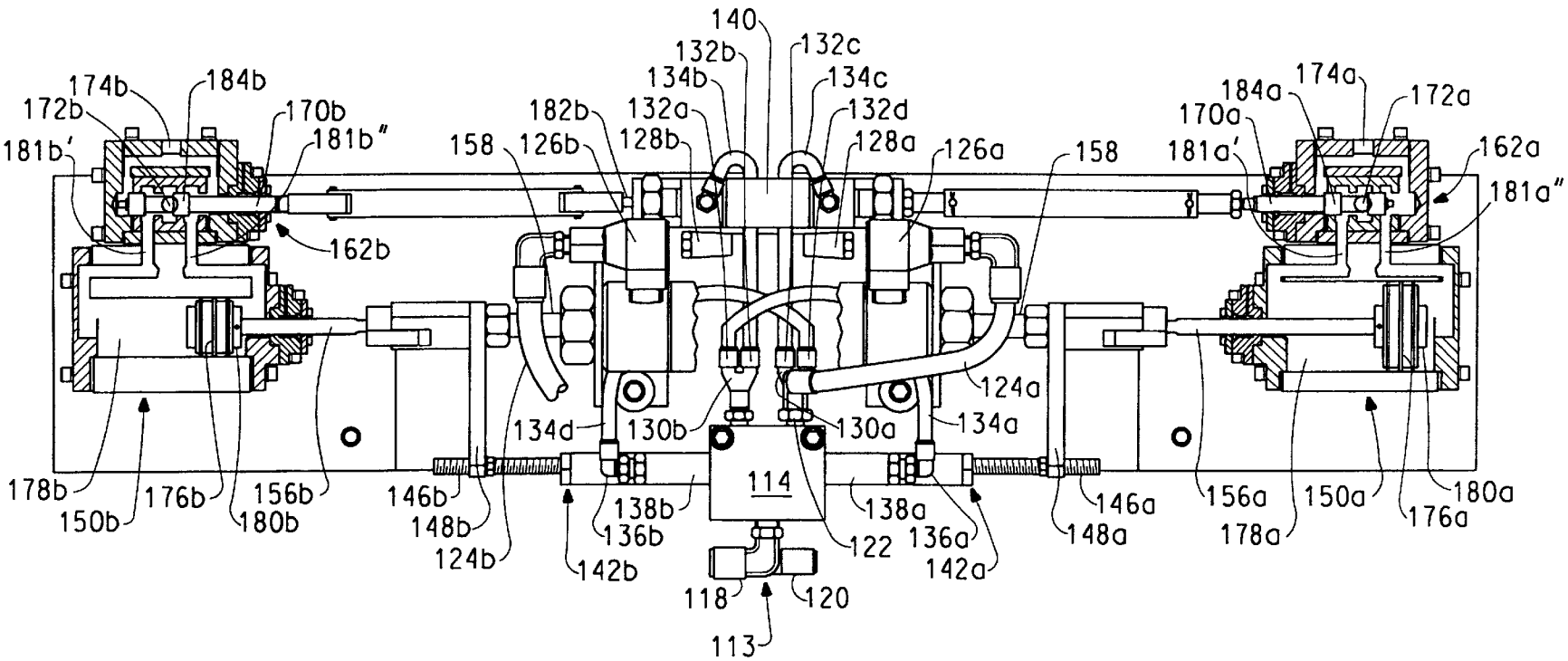
FIG. 2 is a front view of a preferred embodiment of a proportioning system of the invention showing one mode of the liquid pump assemblies and spool valve assemblies in cross-section for two component delivery.
Figure 3:
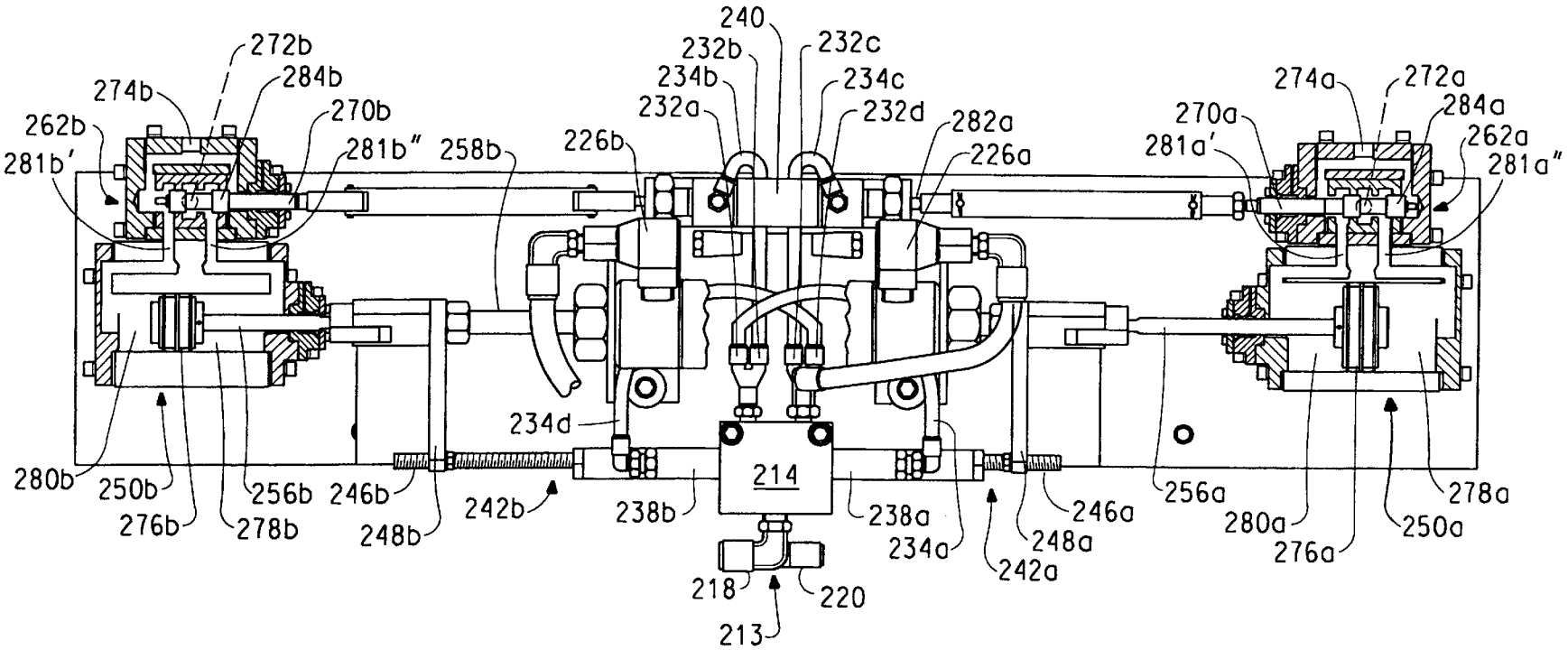
FIG. 3 is a front view of a preferred embodiment of a proportioning system of the invention showing another mode of the liquid pump assemblies and spool valve assemblies in cross-section for two component delivery.

In FIGS. 2 and 3, similar numbers, although seriesed differently, will be used for similar parts with some parts clearly denoted in FIG. 1 and not needed to demonstrate the operation of the multi-component proportioning system of the invention will not be denoted in FIGS. 2 and 3. In FIG. 2, the ratio of the component which can pass through liquid pump assembly 150*a* and spool valve assembly 162*a* and the component which can pass through liquid pump assembly 150*b* and spool valve assembly 162*b* is 3:1, based on the difference in volumetric capacity of each liquid pump assembly.

In FIG. 2, the liquid pumping systems and the spool valve systems, shown in cross-section, show the systems in greater detail. Liquid pump assemblies 150*a*, 150*b* each have pistons 176*a*, 176*b* attached to piston rods 156*a*, 156*b*, respectively. Piston rods 156*a*, 156*b*, are adapted to contact trip plates 148*a*, 148*b* respectively. Trip plates 148*a*, 148*b* are connected to threaded portions of air pilot operator portions 146*a*, 146*b*, respectively, as described with regard to FIG. 1. In liquid pump assemblies 150*a*, 150*b*, component chambers 178*a*, 180*a*, and 178*b* 180*b* are provided and adapted for being filled and emptied of first and second components.

Spool valve assemblies 162*a*, 162*b* include spool valves 184*a*, 184*b*, composition inlet ports 172*a*, 172*b*, and composition outlet ports 174*a*, 174*b*, respectively. Inlet ports 172*a*, 172*b* are adapted for connection to first and second component containers. Composition outlet ports 174*a*, 174*b* are adapted for connection to a dispensing device. In spool valve assemblies 162*a* 162*b*, valve rods 170*a*, 170*b* are connected to spool valves 184*a*, 184*b*, respectively. Spool valve rods 170*a*, 170*b* are connected to piston rods 182*a*, 182*b*, the terminal portion of piston rod 182*b* being shown in FIG. 2 and the terminal portion of piston rod 282*a* being shown in FIG. 3. The spool valve assemblies 162*a*, 162*b* are connected to liquid pump valve assemblies 150*a*, 150*b* by passageways 181*a'*, 181*a"* and 181*b'*, 181*b"*.

With regard to the operation of the multi-component proportioning system, in FIG. 2, pressurized air enters 4-way, 5-port rear valve through air inlet 120 and exits the rear valve through Y-connector 130*a*. Air flowing through port 132*d* flows into air pilot operator portion 138*b*. Air flowing through port 132*c* flows into air cylinder 140 causing rod 182, and ultimately, spool valves 184*a*, 184*b* to move from right to left. At the same time, pistons 176*a*, 176*b* are moving left to right together with piston rods 156*a*, 156*b*, trip plates 148*a*, 148*b*, piston rod 158, and air pilot operators portions 142*a*, 142*b* due to air flowing to line 124*b* from valve 114.

The movement of piston 176*a* causes a first component, such as a paint, to flow into filling chamber 178*a* from inlet 172*a* of spool valve assembly 162*a*. At the same time, the first component, previously loaded into emptying chamber 180*a* is being forced by piston 176*a* to exit through outlet 174*a*. The movement of piston 176*b* causes a second component, such as an activator, to flow into filling chamber 178*b* from inlet 172*b* of spool valve assembly 162*b*. At the same time, the first component, previously loaded into emptying chamber 180*b* is being forced by piston 176*b* to exit through outlet 174*b*.

This action continues until trip plate 148*b* and air pilot operator 142*b* move sufficiently to the right to contact a trip button in the rear valve, causing air to flow into y-connector 130*b* and to ports 132*a* and 132*b*. This causes piston rod 182*b* in air cylinder 40, spool valves 184*a*, 184*b* and connecting members to move left to right. Simultaneously, air flows through line 134*a* to actuate air pilot operator 138*a* and air exhausts through ports 132*c* and 132*d*.

As air pilot operator 138*a* actuates, valve 114 shifts to the left allowing air to flow through line 124*a* and quick exhaust valve 126*a* into cylinder 60. Simultaneously, line 124*b* exhausts allows quick exhaust valve 126*b* to quickly exhaust through optional muffler 128*b* causing air pilot operator 142*a*, 142*b*, trip plates 148*a*, 148*b*, piston rod 158, piston rods 156*a*, 156*b*, and pistons 176*a*, 176*b* to reverse direction such that pistons 176*a*, 176*b* are traveling left to right.

This can be seen in FIG. 3, wherein pressurized air enters 4-way, 5-port rear valve through air inlet 220 and exits the rear valve through Y-connector 230*b*. Air flows from port 232*a* to air pilot operator portion 238*a* and from port 232*b* to air cylinder 240 through line 234*b*. This causes the piston 282*a* and ultimately spool valves 284*a*, 284*b* to move from left to right. The air flowing through line 234*a* into pilot control portion 238*a* causes air pilot control 242*a*, 242*b*, trip plates 248*a*, 248*b*, piston rod 258*b* and ultimately pistons 276*a*, 276*b* to move from right to left. The first component brought into what was filling chamber 178*a* in FIG. 2 is now exiting from what has become emptying chamber 280*a*. Similarly, emptying chamber 180*a* has now become filling chamber 278*a*. The rapid reversal of the spool valves and the pistons in the liquid pump assemblies due to the configuration of the proportioning system and the presence of the quick exhaust valves, virtually eliminates the pulsing, or surging, found in delivery systems using known proportioning systems.

Figure 4:
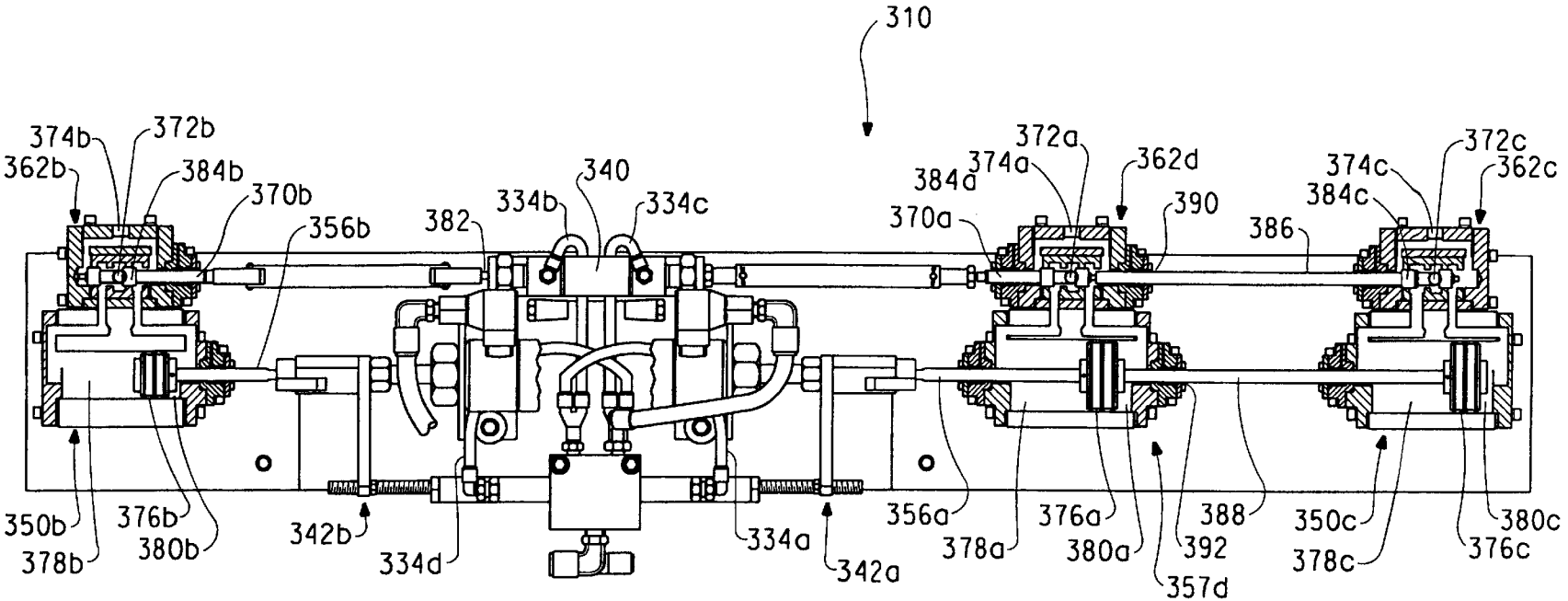
FIG. 4 is a front view of a preferred embodiment of a proportioning system of the invention showing one mode of the liquid pump assemblies and spool valve assemblies in cross-section for three component delivery.

In FIG. 4, a three-component proportioning system is shown. This system differs from the two-component system in that a third unit including a liquid pump assembly and a spool valve assembly are added. As with FIGS. 2 and 3, similar numbers, although seriesed differently, will be used for similar parts with some parts clearly denoted in previous FIGS. and not needed to demonstrate the operation of the three or more-component proportioning systems of the invention will not be denoted in FIG. 4.

In FIG. 4, liquid pump assemblies 350*b, d* and spool valve assemblies 362*b, d* are substantially as shown in FIG. 2. Liquid pump assemblies include pistons 376*a, b*, piston rods 356*a, b*, filling chambers 378*a, b*, and emptying chambers 380*a, b* with liquid pump assembly 350*d* additionally having shaft 392 added and spool valve assemblies 362*b*, d including component inlets 372*a, b*, component outlets 374*a, b*, and spool valve 384*a, b* with spool valve assembly 362*d* additionally having shaft 390 added. The portion of proportioning system 310 located between liquid pump assemblies 350*a, b* and spool valve assemblies 362*a, b* are as shown in FIGS. 1, 2, and 3 with the various valves, ports, lines, trip mechanisms, cylinders, and other parts serving the same functions as described with regard to FIGS. 2 and 3.

In FIG. 4, additional liquid pump assembly 350*c* has been added which includes piston 376*c* and piston rod 388. Piston rod 388 is connected to piston 376*a* through shaft 392 and piston 376*c* and piston rod 388 are axially aligned with pistons 376*a, b* and piston rods 356*a, b*. Liquid pump assembly 350*c* also includes filling chamber 378*c* and emptying chamber 380*c*. Further, in FIG. 4, spool valve assembly 362*d* has been provided with shaft 390 for attachment of valve rod 386. Right hand spool valve assembly 362*c*, has been added and includes component inlet 372*c*, component outlet 374*c* and spool valve 384*c*. Spool valve 384*c* is connected to spool valve 384*a* by valve rod 386 and both spool valve 384*c* and rod 386 are axially aligned with spool valves 384*a, b* and valve rods 370*a, b*. Each of liquid pump assembly 350*c* and 362*c* are attached to each other and to base plate 12.

In proportioning system 310, pistons 376*a, b, c* are capable of moving left to right as in FIG. 2, and adapted to cause filling chambers 378*a, b, c* to fill with components through component inlets 372*a, b, c* and emptying chambers to discharge through component outlets 374*a, b, c* as spool valves 384*a, b, c* move right to left. As described with regard to FIGS. 2 and 3, when the pistons 376*a, b* move sufficiently to the right and spool valves 384*a, b* move sufficiently to the left and the air pressure in lines 334*c, d* is such as to cause air pilot operator 342*b* and to contact the trip button in the rear assembly. Upon contact, rod 382 in cylinder 340 reverses direction, allowing piston 376*c* and spool valve 384*c* to move in the same direction at the same rate as their counterparts in liquid pump assemblies 350*b, d* and spool valve assemblies 362*b, d*.

As can be seen from FIG. 4, additional liquid pump assemblies and spool valve assemblies, aligned as shown in FIG. 4, can be added for additional components. This can be achieved by simply inserting a liquid pump assembly configured as 350*d* and a spool valve assembly configured as 362*d* for each additional component between liquid pump assemblies 350*c, d* and spool valve assemblies 362*c, d*, shown in FIG. 4, with appropriate piston and valve rods.

Figure 5:
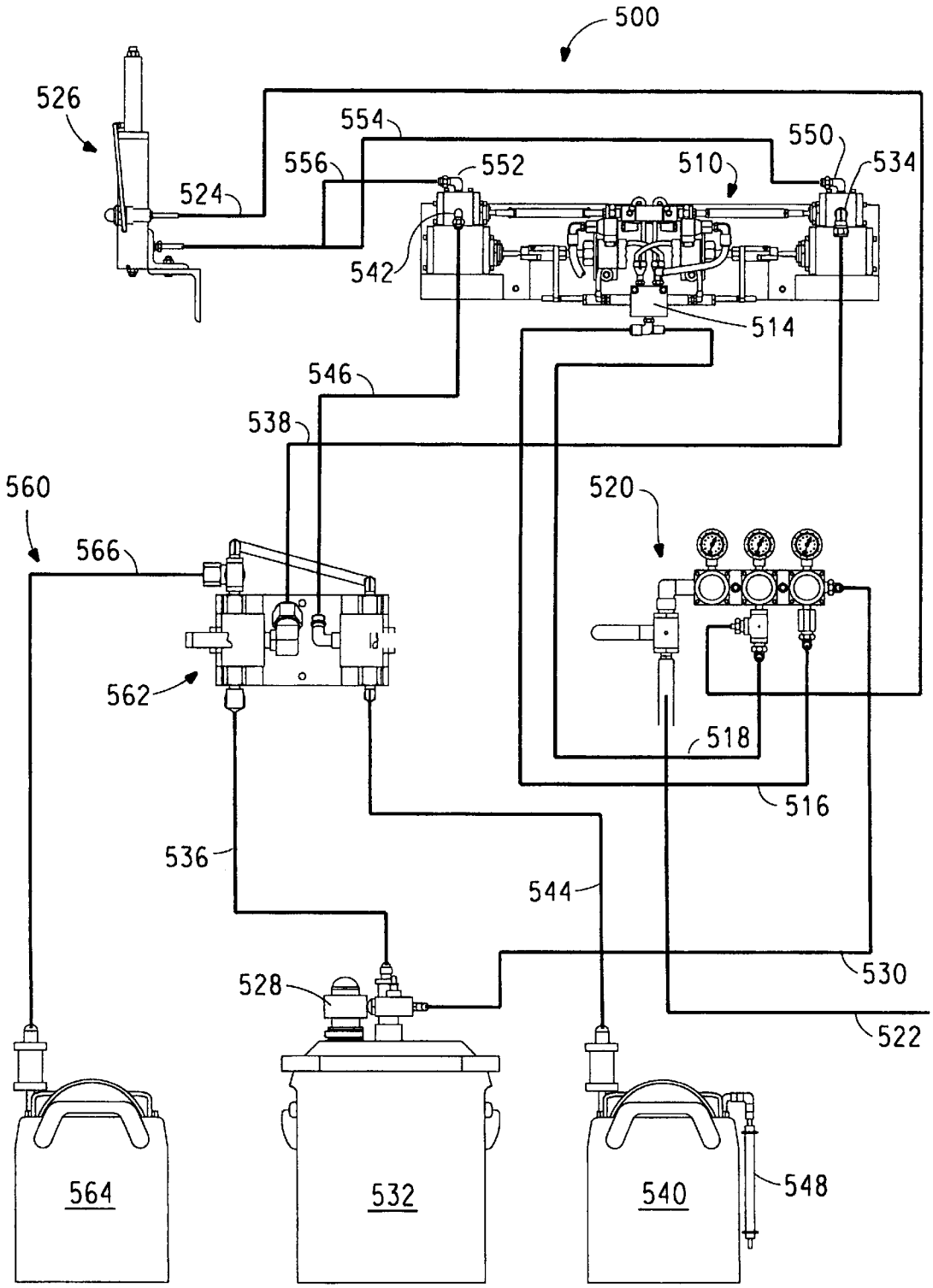
FIG. 5 is a schematic diagram of the delivery system of the present invention utilizing the proportioning system of the invention.

FIG. 5 shows a schematic diagram for a delivery system of the invention utilizing the proportioning system of the invention. In FIG. 5, multi-component delivery system 500 utilizes the type of multi-component proportioning system 510 substantially as shown in FIG. 1. Pressurized air is supplied to 4-way, 5 port valve 514 and rear 4-way, 5-port valve, behind and obscured by valve 514, through air supply lines 516 and 518, respectively, from control unit 520 which is supplied with pressurized air from line 522. Control unit 520 also supplies dispenser air through line 524 to dispenser 526 to aid dispensing of a component mixture exiting dispenser 526. Such control units and dispensers are well-known in the art.

Optionally, compressed air can be provided to operate agitator 528 through line 530 if a component requires agitation to prevent, e.g., separation of materials in the component. Multiple such agitators can be used if required by multiple components. A first component, provided in container 532, is drawn into component inlet 534 through lines 536 and 538 by the action of proportioning system 510. A second component, provided in container 540, is drawn into component inlet 542 through lines 544 and 546 by the action of proportioning system 510. Optional desiccant breather tube 548 may be installed on a container as illustrated with container 540 when the component in the container is particularly sensitive to, or reactive with, moisture.

Proportioning system 510 also supplies the first and second components through component outlets 550 and 552 and component lines 554 and 556, respectively, and delivers them to dispenser 526.

Flushing system 560 is preferably provided to aid in cleaning lines 538 and 546, proportioning system 510, lines 554 and 556, as well as dispenser 526. Such flushing systems are well-known in the art. In such a flushing system, flushing assembly 562 is valved such that the flow of components from lines 536 and 544 can be halted and a cleaning liquid, such as water or a solvent depending on the components being used, can be provided from container 564 through line 566 to flushing assembly 562. The flushing assembly is adjusted, when the component flow is halted, to provide cleaning liquid to lines 538 and 546, proportioning system 510, lines 554 and 556, as well as dispenser 526, by the continued functioning of the proportioning system.

The multi-component proportioning systems and the multi-component delivery systems of the invention are particularly useful in spray paint applications such as, for example, automotive refinishing and spray painting of original equipment manufacturer (OEM) parts. Where multiple components of different colors are required to achieve a desired color match for coating a relatively small area such as, for example, in automobile refinishing applications is particularly efficient. With the present proportioning system, no premixing of components is required, thus reducing waste due to left over mixtures and the delivery and proportioning systems of the invention are readily cleanable with little loss of unused product. Also, two reactive components, one being a color-carrying component and having, for example, hydroxyl or amine groups in the chemical structure of the component, and the other being a component reactive with the color-carrying component, for example, an isocyanate which can react with the hydroxyl or amine groups.

The multi-component proportioning systems and the multi-component delivery systems are also ideally suited where components such as a resin and a curing catalyst for the resin are required to be mixed prior to spraying or coating of the combined components and pot life of the combined components can be a problem, pot life generally referring to the time the combined components remain in a useful condition, i.e., sprayable or coatable and not setup, or hardened.

Another use for the multi-component proportioning systems and the multi-component delivery systems is in the application of certain fast-cure adhesives where mixing is required immediately prior to application. With the present systems, only that amount required needs to used and waste of relatively costly components is reduced. Additionally, the flushing system, when used as part of the delivery system can aid in assuring prompt cleaning of the equipment before the adhesive hardens and renders the component lines, the proportioning system or the dispenser permanently inoperative.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A multi-component proportioning system for a multi-component coating composition comprising:

1) first, second, third and fourth pressurized air ports in a first valve assembly;

2) said second and third pressurized air ports being connected to a first air cylinder proximate a first and second terminal portions thereof;

3) said first and fourth ports being connected to an air cylinder associated with a second valve at the first and second terminal portions thereof;

4) first and second exhaust ports on said second valve and being connected to a second cylinder proximate the first and second terminal portions thereof and to quick exhaust valves;

5) a liquid pump assembly for each component, said liquid pump assembly comprising a piston which moves between a first and second chamber for said component and a piston rod attached to said piston extending beyond said pump assembly;

6) a first and second trip plate adapted for contact with said piston rod associated with said liquid pump assembly for the first and second component;

7) an air pilot operator connected to said trip plate, the air pilot operator being adapted to contact a trip button in said first valve, said trip button determining air flow to said first, second, third and fourth air ports in said first valve; and 8) a spool valve assembly associated with each liquid pump assembly and having a component inlet port and a component outlet port, said inlet and outlet ports being connected to said chambers of said liquid pump assembly by passageways and a spool valve capable of directing incoming component entering from said inlet port to one chamber of said liquid pump assembly through a passageway and allowing outgoing component to exit from said chambers of said liquid pump assembly through a passageway to said component outlet port, each spool valve assembly being further connected to said first air cylinder by connecting rods, said spool valve assemblies for said first and second components being connected to said first and second terminal portions of said first air cylinder, respectively;

such that when:

1) the first and second lines are pressurized with air, air flows from the first line to said second valve and through said first exhaust port and from the second line to the second terminal portion of said first cylinder, said first chambers of said liquid pump assemblies can fill with components through said spool valves attached thereto and components in said second chambers of said liquid pump assemblies can exit past said spool valve, while said piston with its rod moves across said liquid pump assembly and air exhausts through the third and fourth lines;

2) when the third and fourth lines are pressurized with air, air flows from the fourth line to said second valve and through said second exhaust port and from the third line to the first terminal portion of said first cylinder, said second chambers of said liquid pump assemblies fill with components through said spool valves attached thereto and components in said first chambers of said liquid pump assemblies exit past said spool valve and air exhausts through said first and second air ports;

3) when the first trip plate contacts the trip button in the first valve, the air pilot operator in the second valve, the piston and the spool valve simultaneously change direction, the piston and spool valve traveling in opposite directions, the pistons being operated by air pressure and the spool valves being mechanically operated.

2. A multi-component delivery system comprising:

1) a supply source for each component;

2) a multi-component proportioning system for a multi-component coating composition comprising:

a) first, second, third and fourth pressurized air ports in a first valve assembly;

b) said second and third pressurized air ports being connected to a first air cylinder proximate a first and second terminal portions thereof;

c) said first and fourth ports being connected to an air cylinder associated with a second valve at the first and second terminal portions thereof;

d) first and second exhaust ports on said second valve and being connected to a second cylinder proximate the first and second terminal portions thereof and to quick exhaust valves;

e) a liquid pump assembly for each component, said liquid pump assembly comprising a piston which moves between a first and second chamber for said component and a piston rod attached to said piston extending beyond said pump assembly;

f) a first and second trip plate adapted for contact with said piston rod associated with said liquid pump assemblies for said first and second component; p2 g) an air pilot operator connected to said trip plate, said air pilot operator being adapted to contact a trip button in said first valve, said trip button determining air flow to said first, second, third and fourth air ports in said first valve; and h) a spool valve assembly associated with each liquid pump assembly and having a component inlet port and a component outlet port, said inlet and outlet ports being connected to said chambers of said liquid pump assembly by passageways and a spool valve capable of directing incoming component entering from said inlet port to one chamber of said liquid pump assembly through a passageway and allowing outgoing component to exit from said chambers of said liquid pump assembly through a passageway to said component outlet port, each spool valve assembly being further connected to said first air cylinder by connecting rods, said spool valve assemblies for said first and second components being connected to the first and second terminal portions of said first air cylinder, respectively;

such that when:

a) the first and second lines are pressurized with air, air flows from the first line to the second valve and through the first exhaust port and from the second line to the second terminal portion of the first cylinder, the first chambers of the liquid pump assemblies can fill with components through the spool valves attached thereto and components in the second chambers of the liquid pump assemblies can exit past the spool valve, while the piston with its rod moves across the liquid pump assembly and air exhausts through the third and fourth lines;

b) when the third and fourth lines are pressurized with air, air flows from the fourth line to the second valve and through the second exhaust port and from the third line to the first terminal portion of the first cylinder, the second chambers of the liquid pump assemblies fill with components through the spool valves attached thereto and components in the first chambers of the liquid pump assemblies exit past the spool valve and air exhausts through the first and second air ports;

c) when the first trip plate contacts the trip button in the first valve, the air pilot operator in the second valve, the piston and the spool valve simultaneously change direction, the piston and spool valve traveling in opposite directions, the pistons being operated by air pressure and the spool valves being mechanically operated.

3) means for connecting each supply source to the component inlet port on a spool valve assembly;

4) means for connecting each component outlet port to a dispenser adapted to individually deliver the components to a coating device.

3. A method of using a multi-component proportioning system for a multi-component coating composition comprising the steps of:

1) providing an air pilot valve assembly comprising first and second 4-way, 5-port valves, each valve having a pressurized air inlet, said first valve having first and second Y-connectors and an air pilot operator adapted to trip a trip button within said first valve to direct air flow to said Y-connectors and said second valve having first and second air inlet ports and first and second primary exhaust ports;

2) providing a liquid pump assembly for each of at least two components, said liquid pump assembly comprising a piston which moves between a first and second chamber for said component and a piston rod attached to said piston extending beyond said pump assembly, each of said liquid pump assembly piston rods for said first and second components being adapted to contact a trip plate, and said trip plate being connected to a piston rod adapted to traverse a second cylinder;

3) providing a spool valve assembly associated with each liquid pump assembly and having a component inlet port and a component outlet port, said inlet and outlet ports being connected to said chambers of said liquid pump assembly by passageways and a spool valve capable of directing incoming component entering from said inlet port to one chamber of said liquid pump assembly through a passageway and allowing outgoing component to exit from said other chamber of said liquid pump assembly through a passageway to said component outlet port, each spool valve assembly being further connected to a first air cylinder by connecting rods, the spool valve assemblies for said first and second components being connected to the first and second terminal portions of said first air cylinder, respectively;

4) when discharge of components through component outlet ports is desired, providing pressurized air to said air inlet of said first 4-way, 5-port valve and allowing said air to exit said first valve through said first Y-connector;

5) allowing air flowing through a first port of said first Y-connector to enter into a terminal portion of a first air pilot operator portion;

6) allowing air flowing through a second port on said first Y-connector to flow into said first air cylinder and to cause a piston rod and a piston located within said first air cylinder and aligned with a central axis thereof and said spool valves to travel in a first direction;

7) allowing air to flow from said second exhaust valve of said air pilot valve assembly to an exhaust line connected to a second air cylinder and a first quick exhaust valve causing pistons and piston rods of said liquid pump assembly, said trip plate, said piston rod in said second air cylinder and said air pilot operator to travel in a direction opposite to that of said spool valves;

8) providing a component for each liquid pump assembly and associated spool valve assembly;

9) permitting said liquid pump assembly for each component to draw said component into said first chamber of said liquid pump assembly through said component inlet port of said spool valve assembly associated therewith and causing component contained in said second chamber of said liquid pump assembly to exit through said component outlet port of said spool valve assembly associated therewith;

10) allowing said spool valve and associated piston rods to continue travel in a first direction and said piston in said liquid pump assembly, said trip plate and said air pilot operator to continue travel in said opposite direction until sufficient travel has occurred that said air pilot operator contacts said trip button in first valve of said air operator assembly system causing air to flow into said second Y-connector;

11) allowing air flowing through a first port of said second Y-connector to enter into a terminal portion of a second air pilot operator portion;

12) allowing air flowing through a second port on said second Y-connector to flow into said first air cylinder and to cause said piston rod and a piston located within said cylinder and said spool valves to reverse direction and to travel in a second direction opposite to said first direction;

13) allowing air to flow simultaneously with that of the air flowing through said port on said second Y-connector from said first exhaust valve of said air pilot valve assembly to an exhaust line connected to said second air cylinder and said second quick exhaust valve causing pistons and piston rods of said liquid pump assembly, said trip plate, said piston rod in said second air cylinder and said air pilot operator to reverse direction and travel in a direction opposite to that previously traveled;

14) permitting said liquid pump assembly for each component to draw said component into said second chamber of said liquid pump assembly through said component inlet port of said spool valve assembly associated therewith and causing component contained in said first chamber of said liquid pump assembly to exit through said component outlet port of said spool valve assembly associated therewith;

15) allowing said spool valve and associated piston rods to continue travel in said second direction and said piston in said liquid pump assembly, said trip plate and said air pilot operator to continue travel in the direction opposite to that previously traveled until sufficient travel has occurred that said air pilot operator contacts said trip button in first valve of said air operator assembly system causing air to flow into said first Y-connector; and 16) repeating steps 5 through 15 until stoppage of delivery of said components is desired.

* * * * *